United States Patent [19]

Gringer

[11] Patent Number: 4,509,260

[45] Date of Patent: Apr. 9, 1985

[54] KNIFE HANDLE FOR ACCOMMODATING DIFFERENT ADJUSTABLE BLADE TYPES

[76] Inventor: Donald Gringer, 1 Bishop Rd., Bedford, N.Y. 10506

[21] Appl. No.: 512,962

[22] Filed: Jul. 12, 1983

[51] Int. Cl.[3] ..... B26B 1/00

[52] U.S. Cl. ..... 30/162; 30/125; 30/320; 30/335

[58] Field of Search ..... 30/125, 162, 293, 320, 30/331, 335, 337, 339, 294

[56] References Cited

U.S. PATENT DOCUMENTS

| | | | |
|---|---|---|---|
| 3,192,624 | 7/1965 | Gringer | 30/162 |
| 3,660,896 | 5/1972 | Umboltz | 30/162 X |
| 3,906,625 | 9/1975 | Gringer | 30/331 X |
| 4,005,525 | 2/1977 | Gringer | 30/162 X |
| 4,242,795 | 1/1981 | Rollband et al. | 30/320 |

FOREIGN PATENT DOCUMENTS

| | | | |
|---|---|---|---|
| 2704019 | 3/1978 | Fed. Rep. of Germany | 30/335 |

*Primary Examiner*—E. R. Kazenske
*Assistant Examiner*—William Fridie, Jr.
*Attorney, Agent, or Firm*—Hubbell, Cohen, Stiefel & Gross

[57] ABSTRACT

An improved retractable knife includes a frontal part of the blade carrier, which has a bottom blade supporting ledge, is embodied as a pallet adapted to firmly mount and support the area of the blade which remains within the handle so that there is no play or rattle of the blade irrespective of whether an apertured or solid blade is mounted on the carrier. The pallet has a plurality of register pins receivable in corresponding notches provided in a trapezoidal type cutting blade at the edge opposite the blade cutting edge. The pallet further comprises a first longitudinally extending pair of cantilevered arms for providing a first blade side support substantially centrally disposed at said frontal part, one of the arms having a front lug and the other of the arms having a rear blade guide in the direction of movement of the carrier out of the handle and a second blade side support disposed beneath the cantilevered arms blade side support having a second rear edge blade guide, the first rear edge blade being aligned with the register pins and the front lug for firmly removably mounting an apertured blade with the front lug disposed in the central aperture of the blade, the register pins disposed in the blade notches, the rear of the cutting edge of the mounted blade being disposed against the bottom ledge of the carrier and the rear of the mounted blade being disposed against the first rear edge blade guide. If a solid type notched blade is mounted on the carrier instead of the aforementioned apertured type notched blade, then the rear edge of the solid type blade is disposed against the second rear edge blade guide within the register pins disposed in the blade notches, and the solid blade side laterally biases both of the cantilevered arms in the closed knife so as to laterally bias the front lug and first rear edge blade guide for enabling the solid type blade to be firmly mounted on the carrier. Accordingly, different types of blades may be interchangeably mounted on the carrier for use in the knife.

9 Claims, 7 Drawing Figures

KNIFE HANDLE FOR ACCOMMODATING DIFFERENT ADJUSTABLE BLADE TYPES

TECHNICAL FIELD

My present invention relates to utility type knives and, more particularly, to a utility knife whose blade is changeable and resettable in one of selected axial positions and can be completely retracted into a hollow handle.

BACKGROUND ART

A retractable knife of the above-mentioned type was described in detail in my prior U.S. Pat. No. 3,192,624 issued on July 6, 1965. In this utility knife, one of the important members is a blade carrier which is axially movable within the handle to extend or to retract the blade. This carrier is an oval loop of a tough resilient plastic provided with a forward extending rigid arm to support the blade in its central rectangular aperture and also with a flexible rear arm to bias a rear portion of the blade in one transversal direction. The carrier carriers a control button and normally locked detents which, when the button is depressed, are temporarily released to allow shifting of the carrier and the blade in a selected axial position. My prior patented utility knife, although satisfactory in most instances, cannot readily accomodate the variety of different types of utility blades commercially available.

Such commercially available utility blades generally fall into two categories, i.e. those having three notches on the edge opposite the cutting edge with a central blade aperture for stability of the blade during cutting such as illustrated in my prior U.S. Pat. Nos. 3,906,625 and 4,005,525, and, solid blades having only two notches on the edge opposite the cutting edge. In certain cutting applications, use of the solid blade type is preferred, whereas in other cutting applications use of the apertured blade type is preferred. However, applicant is not aware of any commerically available utility knives which readily accommodate both types of blades on a common blade carrier, where aperture indent springs out of way. For example, when it is attempted to use a solid type blade on the blade carrier of my prior U.S. Pat. No. 3,192,624, the blade cannot satisfactorily be mounted on the center and, thus, the utility knife cannot operate properly. Thus, my prior patented knife, although satisfactory for cutting applications in which an apertured blade is employed, cannot readily be used with a solid type blade as well. This disadvantage of the prior art are overcome by the present invention.

DISCLOSURE OF THE INVENTION

In an improved retractable knife in accordance with my present invention, a frontal part of the blade carrier, which has a bottom blade supporting ledge, is embodied as a pallet adapted to firmly mount and support the area of the blade which remains within the handle so that there is no play or rattle of the blade irrespective of whether an apertured or solid blade is mounted on the carrier. The pallet has a plurality of register pins receivable in corresponding notches provide in a trapezoidal type cutting blade at the edge opposite the cutting edge. The pallet further comprises a first longitudinally extending pair of cantilevered arms for providing a first blade side support substantially centrally disposed at the frontal part, one of the arms having a front lug and the other of the arms having a rear blade guide in the direction of movement of the carrier out of the handle and a second blade side support disposed beneath the cantilevered arms blade side support having a second rear edge blade guide. The first rear edge blade guide is aligned with the register pins and the front lug for firmly removably mounting an apertured blade with the front lug disposed in the central aperture of the blade, the register pins disposed in the blade notches, the rear of the cutting edge of the mounted blade being disposed against the bottom ledge of the carrier and the rear of the mounted blade being disposed against the first rear edge blade guide. The balance of the carrier, which comprises a flexible beam, is similar to that previously described in my prior U.S. Pat. No. 3,192,624, the contents of the which are specifically incorporated by reference herein in its entirety. In addition, if a solid type notched blade is mounted on the carrier instead of the aforementioned apertured type notched blade, then the rear edge of the solid type blade is disposed against the second rear edge blade guide with the register pins disposed in the blade notches, and the solid blade side laterally biases both of the cantilevered arms in the closed knife so as to laterally bias the front lug and first rear edge blade guide for enabling the solid type blade to be firmly mounted on the carrier. If desired, as was true in connection with the carrier described my prior U.S. Pat. No. 3,192,624, the entire carrier can be integrally molded of a tough plastic material, such as Delrin. Moreover, the register pins may preferably have a semicircular cross-section and flat chamfers aligned with a slide of the pallet which is opposite to the cutting edge. These pins are arranged to readily accomodate blades having either two or three notches. In order to provide the aforementioned support of a blade with three notches and a rectangular central aperture, the front lug is preferably shaped to match this aperture.

BRIEF DESCRIPTION OF DRAWINGS

The above and other features and advantages of my present invention will now be described in detail with reference to the accompanying drawings in which.

BEST MODE FOR CARRYING OUT THE INVENTION

Figure 1:
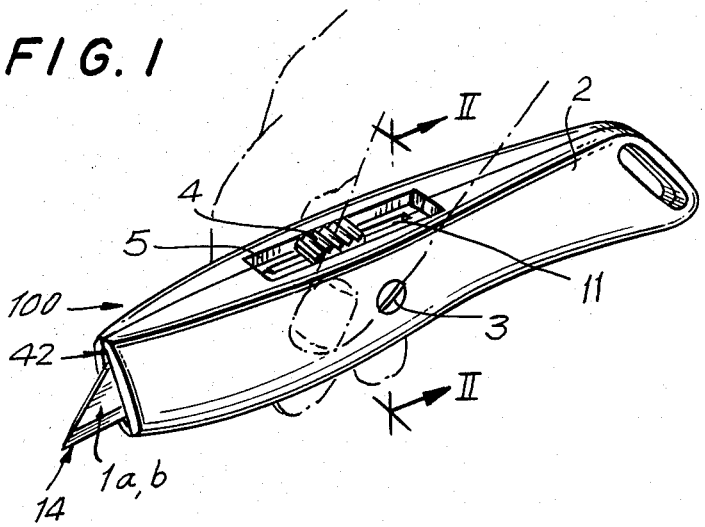
FIG. 1 is a perspective view of retractable knife with a blade in a partially retracted position.
Figure 2:
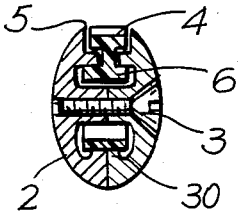
FIG. 2 is a cross-sectional view of the knife taken on the line II—II of FIG. 1.

Referring now to FIGS. 1 and 2, an improved utility type knife, generally referred to by reference numeral 100, according to the present invention is shown. As will be described in greater detail hereinafter, the improved utility knife 100 of the present invention is an improvement of my prior patented utility knife of U.S. Pat. No. 3,192,624, and can accomodate different types of blades such as a solid type blade 1*a* or an apertured type blade 1*b*. As illustrated in FIG. 1, the blade 1*a*, 1*b* is axially retractable into a hollow elongated handle 2 conveniently shaped for gripping by hand and constituting a case for the knife 100. The handle 2, as is true in my prior U.S. Pat. No. 3,192,624, is formed by a pair of complementary shells attached to one another in face-to-face relationship by means of a thread connection 3. Outside the handle, a manually operated control button 4 is located which is movable in a groove 5 for setting the blade 1*a* or 1*b* in one of selected axial positions in the manner described in my aforementioned U.S. Pat. No. 3,192,624. The blade 1*a* or 1*b* is preferably supported in the handle 2 by an improved carrier 6 associated with the button 4.

Figure 3:
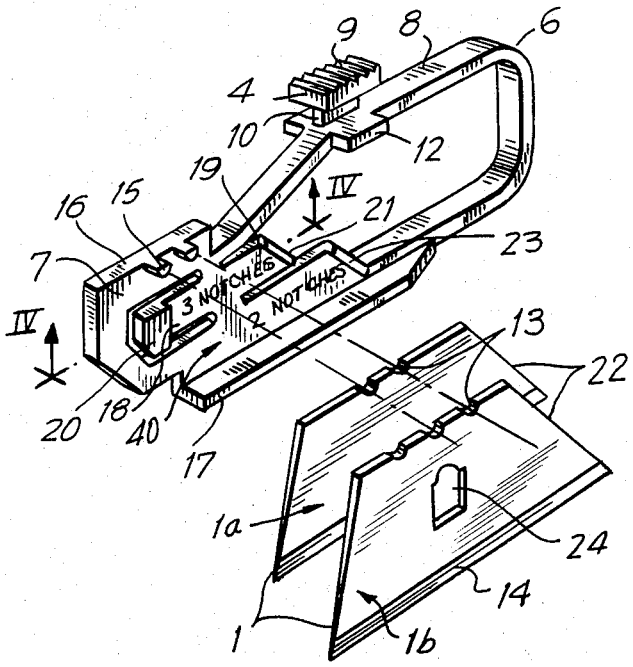
FIG. 3 is a perspective view of the improved carrier of the present invention capable of firmly mounting and supporting the two different types of illustrated trapezoidal cutting blades, by way of example, in the improved knife of the present invention.
Figure 5:
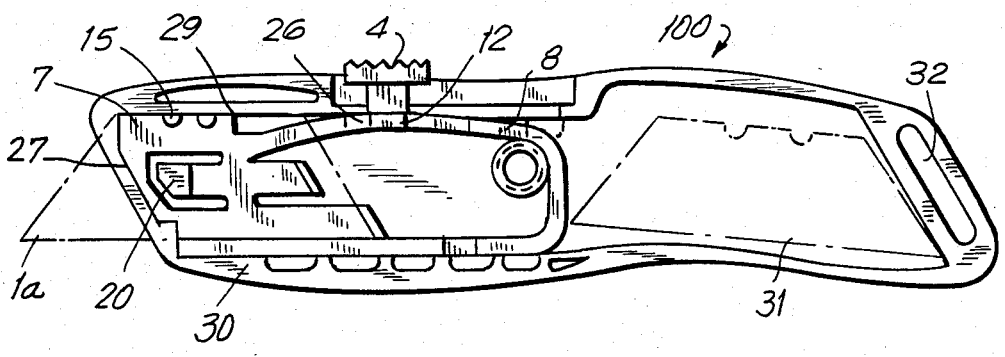
FIG. 5 is an elevational view of a shell constituting one half of the hollow handle of the knife according to the invention, the blade being illustrated in dotted line in a forwardmost position.
Figure 7:
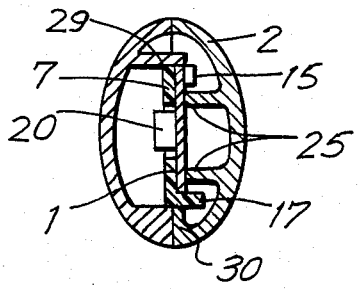
FIG. 7 is a cross-sectional view of the knife when assembled, taken on the line VII—VII of FIG. 6.

According to my present invention, the improved carrier 6 of the present invention, which is clearly shown in FIG. 3, preferably comprises a frontal pallet 7 adapted to support the area of the blade 1*a* or 1*b* which remains inside the handle 2 even in a forwardmost position of the carrier 6 (FIG. 5). As was illustrated in FIG. 7 of my prior U.S. Pat. No. 3,192,624 incorporated by reference herein, the carrier 6 comprises a flexible beam 8 formed of a tough resilient plastic material, such as Delrin. The improved carrier 6, however, of the present invention also preferably includes the frontal pallet 7, which is integrally molded in combination with the generally loop-shaped flexible beam 8 whose upper branch preferably carries the button 4 having external serrations 9. The button 9 is connected to the beam 8 via a relatively narrow vertical neck 10 slideable in a longitudinal slot 11 (FIG. 1) of the handle and the beam 8 under the button 4 has two oppositely projected transversal detents 12.

As was previously mentioned, different types of blades 1*a*, 1*b* may be interchangeably used in the improved knife 100 of the present invention, such as the solid type blade 1*a*, having only two notches 13 in the edge opposite to the cutting edge 14 of the blade 1*a*, or the apertured type 1*b* having three notches 13 in the edge opposite to the cutting edge 14 of the blade 1*b* and a central generally rectangular aperture 24, such as in the blade employed in my prior model of the knife. In the assembled position, these notches 13 match register pins 15 located at the upper edge of the pallet 7 with these pins 15 preferably having corresponding semicircular cross-sections and flat chamfers aligned with an upper slide 16 of the pallet 7. The carrier 6 also preferably includes a bottom flange or ledge 17 which also presents a supporting protecting surface for the cutting edge 14 of the blade snugly registered between the pins 15 and the flange 17. Additionally, the rear edge of the blade 1*a* or 1*b* is held by a respective inclined flange or rear edge blade guide 21 or 23 to keep the mounted blade 1*b* or 1*a*, respectively, securely and firmly mounted in place on the pallet 7 with the cutting edge 14 of the mounted blade 1*a* or 1*b* resting against ledge 17 and the opposite edge of the blade 1*a* or 1*b* having the register pins 15 in the corresponding notches 13. In addition, the rear edge of the mounted blade 1*a* or 1*b* is disposed against the corresponding rear edge blade guide 23 or 21, respectively. Moreover, if the blade 1*b* is the apertured type, front lug or pad 20 will also be disposed in the central aperture 24 thereof.

Figure 4:
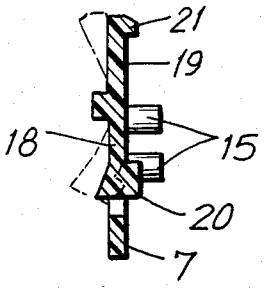
FIG. 4 is a cross-sectional view taken on the line IV—IV of FIG. 3 showing cushioning elements of the pallet and illustrating the lateral deflection of the cantilevered arms in dotted lines which occurs when accomodating a solid type blade.

As further shown and preferred in FIGS. 3 and 4, the improved carrier 6 pallet 7 includes a pair of oppositely extending cantilevered arms 18 and 19. These arms preferably comprise a first blade side support having at one end of arm 18, lug or pad 20 adapted to either resiliently cushion the side of a solid type blade 1*a* pressed against the pallet 7 if such a blade is employed, or to reside in central aperture 24 of the apertured type blade 1*b* if such a blade is employed. Thus, lug 20 on arm 18 is preferably shaped to match the rectangular aperture 24 of apertured type blade 1*b* when such a blade 1*b* is employed. In addition at the other end of arm 19, rear edge blade guide or pad 21 is located which resiliently cushions the side of solid type blade 1*a* when blade 1*a* is employed and serves as a limiting flange or rear edge guide when blade 1*b* is employed.

As was previously mentioned, when the solid type blade 1*a* is employed, the rear edge guide 23 on the lower blade side support 40 serves as a limiting flange for blade 1*a*. The dotted lines in FIG. 4 illustrate the deflected or laterally biased positions of the cantilevered arms 18 and 19 when the two-notched or laterally biased blade 1*a* is supported on the pallet 7 of the carrier 6 and the handle 2 has been assembled as in FIG. 1. This enables the blade 1*a* or 1*b* to be aligned with the slot 42 in the assembled handle 2 irrespective of which type of blade 1*a* or 1*b* is employed. It should be noted that the pads 20 and 21 although different in shape, preferably, equally laterally project from a common face surface of the pallet 7 and are preferably of a shorter lateral extent than the register pins 15 (FIG. 4).

Figure 6:
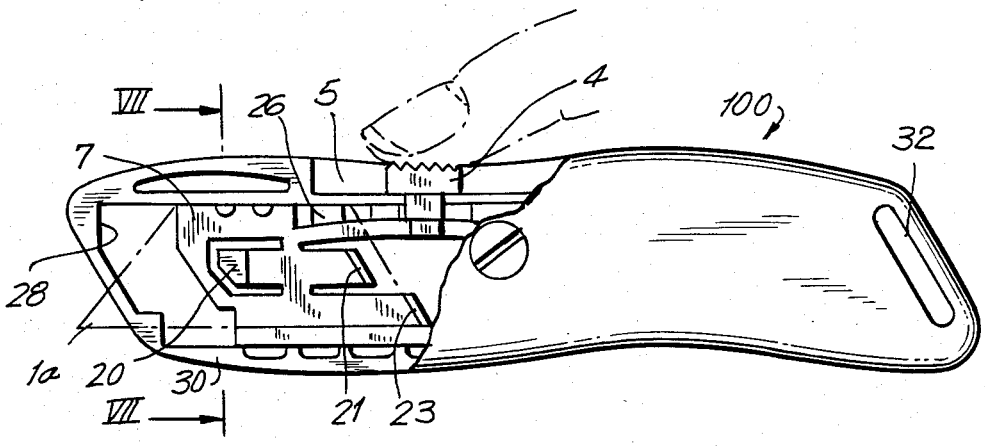
FIG. 6 is an elevational view similar to FIG. 5 with a button of the carrier depressed and the blade illustrated in dotted lines located in an intermediate position along the handle.

FIGS. 5 and 6 show details of the inside structure of the retractable knife 100 according to the present invention. In the forwardmost position of the carrier 6 (FIG. 5), the detents 12 are securely locked between two adjacent stops 26. These stops are provided symmetrically in the shells of the handle 2 along the slot 11 at equal intervals from each other to arrest the carrier 6 in a predetermined axial position in the manner previously described in my aforementioned U.S. Pat. No. 3,192,624.

A frontal portion 27 of the pallet 7 has a distinctive multiangular profile which is intended to be securely locked in a complementary socket 28 provided inside the handle 2 to ensure the rigidity of the position of the carrier 6 in its forwardmost position when the blade 1*a* is subjected to heavy duty. The locking of the frontal portion 27 of the pallet 7 is supported by holding the slide 16 and that provided by the bottom flange 17 in guides 29 and 30 of the handle 2.

At the same time, the detachable or removable blade 1*a* or 1*b* is securely held relative to the pallet 7 by longitudinal ribs 25 (FIG. 7) constituting backing means for permanently pressing the blade 1*a* or 1*b* against the pallet 7, the cushioning pads 20, 21 and flanges. As was true in my prior patented utility knife of U.S. Pat. No. 3,192,624, a rear portion of the handle 2 provides room for storing spare blades 31, which can now be of either of both types 1*a*, 1*b*. This portion terminates with a hook having an aperture 32 for handy engaging of the knife 100 when out of use.

FIG. 6 illustrates a transitory moment in the operation when the carrier 6 and the blade 1*a* are in an intermediate position. With the button 4 being manually depressed, the beam 8 is resiliently deformed pushing the detents 12 out of engagement with the stops 26. The carrier 6 and the blade 1*a* are ready to be easily shifted in a selected axial position back and forth within the handle 2. When the button 4 is released, the beam 8 resiliently regains its initial position and the detents 12 are again locked between the respective stops 26, ensuring thereby a desired projection of the cutting edge 14 and a selected depth of cutting.

As was previously mentioned, the knife 100 described above has many structural details in common with the knife according to my earlier U.S. Pat. No. 3,192,624 which is hereby incorporated by reference. The carrier 6 can be also expediently made of acetal thermoplastic resin such as Du Pont's "Delrin", or Celanese's "Celcon".

It is understood that various modifications are possible in arrangements of cushioning elements, register pins etc. without departing from the spirit and scope of the present invention.

What is claimed is:

1. In an improved retractable knife comprising a housing defining a hollow interior chamber with a passage thereinto from the front of said housing, said chamber having a top and a bottom, a longitudinal slit extending from the top of said housing into said chamber at the top thereof, a blade carriage within said chamber, said carriage being made of a tough resilient plastic and comprising a simple beam of resilient material, a button disposed outside said housing at the top thereof, and means for connecting said button to a central portion of said beam, said carriage being slidable in said housing toward and away from said passage, said connecting means extending through said slit and being movable therealong when said carriage slides within said chamber, means for supporting said beam at both ends, said beam being deflectable between said supporting means in a given plane, a blade detachably secured to said carriage in a plane that is parallel to said given plane of deflection of said beam, and detent means associated with said carriage and said housing for releasably holding said carriage against said sliding movement, said detent means being released when said resilient simple beam is deflected; the improvement comprising a pallet formed at the frontal portion of said beam, said pallet comprising a plurality of spaced apart register pins disposed along an upper edge thereof, a blade carrying ledge disposed along an opposed lower edge thereof, a pair of longitudinally extending vertically spaced apart blade side support members disposed between said upper and lower edges, one of said blade side support members being disposed substantially along the longitudinal axis of said beam and comprising a pair of flexible laterally biasable cantilevered arms cantilevered from a support member, the forwardmost arm having a lug disposed at the distal end thereof and the rearwardmost arm having a first rear edge blade guide element disposed at the distal end thereof with respect to the support member from which said arms are cantileverd, said other blade side support member disposed adjacent said ledge and having a second rear edge blade guide element at the distal end thereof, said blade side support members being capable of interchangeably securely supporting at least solid type blades and apertured type blades on said carrier, said cantilevered arms being laterally biased under lateral loading from a solid type blade while said solid type blade is engagingly retained between said second rear edge blade guide in cooperation with said register pins and said ledge, and further being capable of interchangeably engagingly retaining an apertured type blade between said lug and first rear edge blade guide in cooperation with said register pins and ledge; whereby different type blades may be interchangeably mounted for use in said retractable knife.

2. An improved retractable knife in accordance with claim 1 wherein said pallet is integrally formed with said flexible beam.

3. An improved retractable knife in accordance with claim 2 wherein said pallet and beam are formed of a non-stick, hard resiliant resin.

4. An improved retractable knife in accordance with claim 3 wherein said flexible beam comprises a substantially oval member.

5. An improved retractable knife in accordance with claim 4 wherein said oval member contains a pair of lugs extending from both sides of the upper portion of said oval member to provide a detent for engaging said housing detent means.

6. An improved retractable knife in accordance with claim 1 wherein said second rear edge blade guide is more longitudinally rearward than said first rear edge blade guide.

7. An improved retractable knife in accordance with claim 6 wherein said plurality of register pins comprises two pins interchangeably cooperable both with two notch and three notch blades.

8. An improved retractable knife in accordance with claim 7 wherein said register pins have a semicircular cross-section and flat chamfers aligned with the surface of one of the rear edge blade guides, the height of said pins exceeding at least one width of the blade.

9. An improved retractable knife in accordance with claim 1 wherein said register pins have a semicircular cross-section and flat chamfers aligned with the surface of one of the rear edge blade guides, the height of said pins exceeding at least one width of the blade.

* * * * *